United States Patent [19]

Netto et al.

[11] 4,012,871

[45] Mar. 22, 1977

[54] MODULAR HOUSING UNITS

[75] Inventors: Tito Livio Martins Netto; Ludgero Raul Barbetta, both of Sao Paulo, Brazil

[73] Assignee: Acacia Engenharia Industria E Commercio, Sao Paulo, Brazil

[22] Filed: Dec. 1, 1972

[21] Appl. No.: 311,100

[30] Foreign Application Priority Data

Dec. 1, 1971 Brazil ..... 000071

[52] U.S. Cl. ..... 52/79.4; 52/90; 52/79.1

[51] Int. Cl.[2] ..... E04B 1/348

[58] Field of Search ..... 52/92, 93, 90, 79, 236

[56] References Cited

UNITED STATES PATENTS

| | | | |
|---|---|---|---|
| 1,261,173 | 4/1918 | Stadelman | 52/92 |
| 2,904,849 | 9/1959 | Bergstrom | 52/143 |
| 3,236,014 | 2/1966 | Edgar | 52/92 |
| 3,479,781 | 11/1969 | Tohrson | 52/236 |
| 3,526,067 | 9/1970 | Furter | 52/236 |
| 3,665,662 | 5/1972 | Timbrook | 52/92 |
| 3,720,022 | 3/1973 | Pattner | 52/236 |

FOREIGN PATENTS OR APPLICATIONS

| | | | |
|---|---|---|---|
| 1,581,473 | 9/1969 | France | 52/79 |
| 6,803,804 | 9/1968 | Netherlands | 52/79 |

OTHER PUBLICATIONS

The Red Book of Lathing & Plastering, pp. 17, 45 and 48, 1967.

*Primary Examiner*—Price C. Faw, Jr.
*Assistant Examiner*—Henry Raduazo
*Attorney, Agent, or Firm*—Steinberg & Blake

[57] ABSTRACT

Modular housing units each including identical floor and roof structures as well as walls made up of panels of identical size assembled together with some of these panels including window structures and door structures. Ceiling panels are of the same shape and size as the wall panels. The floor and roof structures are such that the floor structure of one unit can be placed on the roof structure of a next-lower unit. Thus modular units can be assembled at a common elevation enabling a number of the modular units to be combined to provide a given housing area of any desired size and in addition the modular units can be assembled vertically to provide both vertical and horizontal assemblies of the modular units.

6 Claims, 11 Drawing Figures

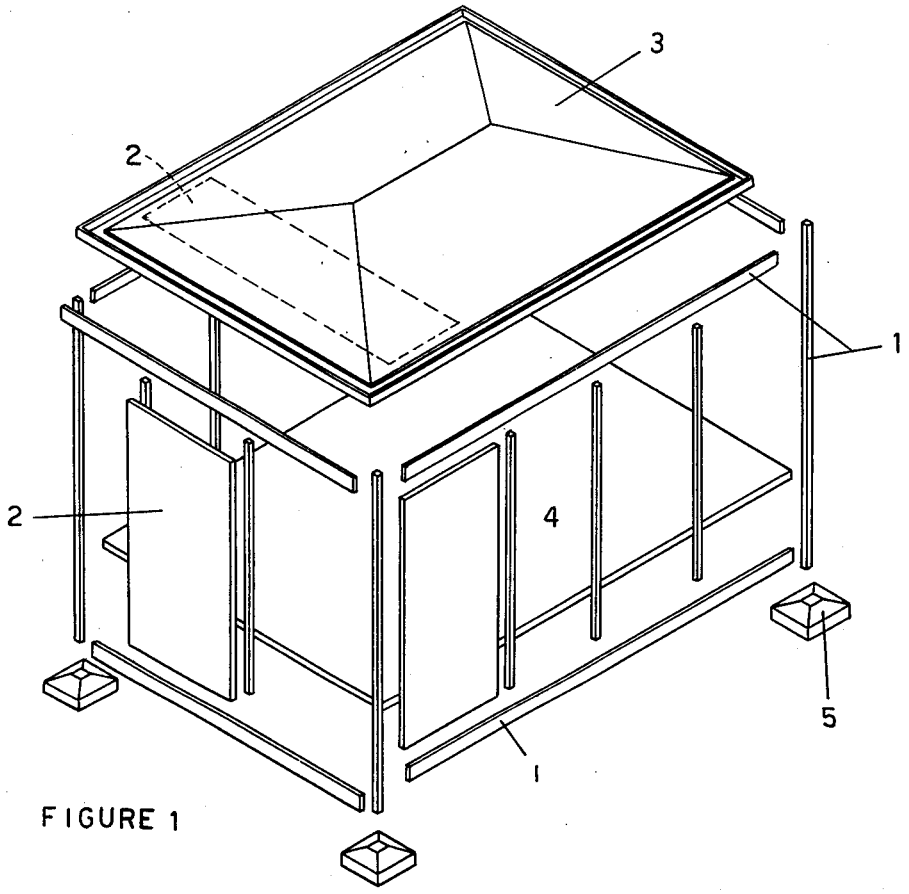
FIGURE 1
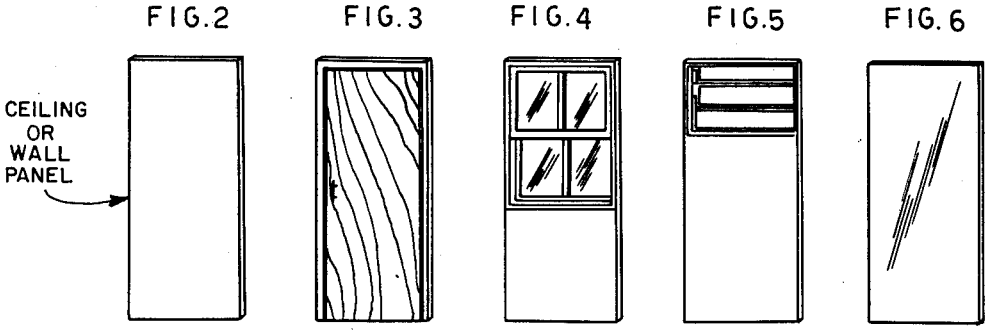

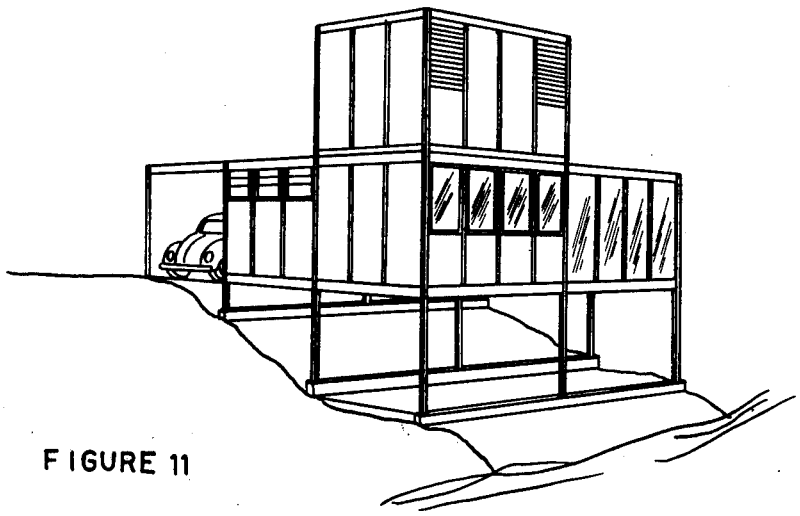
FIGURE 11
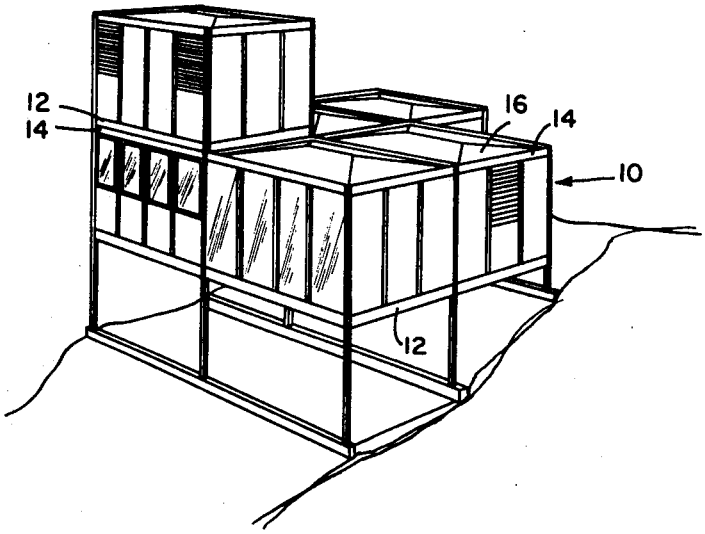

MODULAR HOUSING UNITS

The new construction arrangement is provided with independent cells with a great versatility, permitting the erection of any type of construction, which cells are pre-fabricated and may be totally finished at the plant on assembly lines and carried to the desired destination, where they are grouped and quickly secured to the ground. Or, further, they may be totally assembled at the plant, if this is deemed convenient.

The object of this invention is to attempt to technically and economically solve the problems of civil construction, and particularly in the housing field. Since these are constructions obtained by means of a highly industrialized procedure, using the most modern and varied materials, it will minimize or even solve the housing problem. It will preferably favour the poor classes, rendering possible the dream of owning a house.

As stated, this construction arrangement may not only solve the housing problem, but also offer substantial advantages, as to cost and time, in other fields such as the construction of hotels, motels, schools, hospitals and the like, both in the commercial and in the industrial fields.

In order to better illustrate the present report, reference is made to the attached drawings, which are submitted for demonstration and not for restrictive purposes, and in which:

FIG. 1 is a perspective exploded schematic illustration of components used in a modular housing unit of the invention;

FIG. 2 illustrates a ceiling or wall panel;

FIG. 3 shows such a panel modified to have a door;

FIG. 4 shows such a panel modified to have a window;

FIG. 5 shows such a panel modified so as to form a complete or partial closure;

FIG. 6 illustrates a glass plate;

FIG. 11 illustrates how the modular units may be grouped horizontally and vertically.

Figure 7:
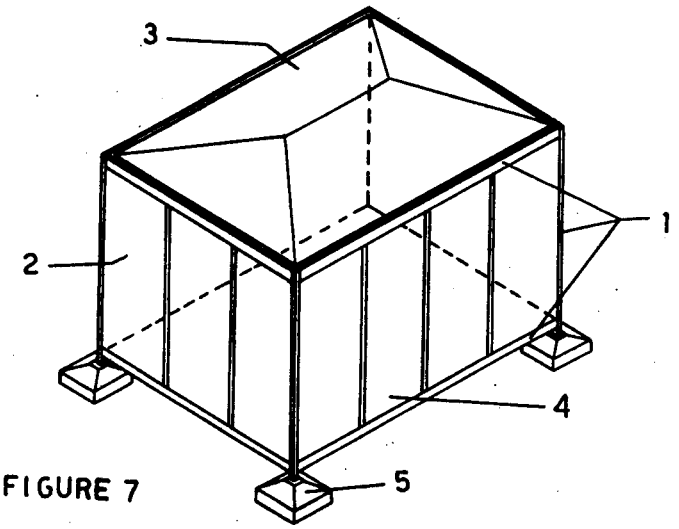
FIG. 7 is a perspective view of modular housing unit of the invention.

FIG. 1 — The cell consists of: a structure 1, panels 2, roof, ceiling and trough 3, floor 4 and foundation brackets 5, such components forming a stanch assembly, that is, each cell is provided with its own structure, sealing panels, entirely independent roofing in relation to integral throughs thereof, floor and brackets firmly securing the cell to the ground.

Structure 2 — The material utilized in the structure may be: steel, aluminum, plastic or other material, providing conditions of mechanical resistance consistent with building codes and further with stress and wear factors, so as to ensure a great durability thereto.

Ceiling and dividing panels 2 — Panels may be compact, hollow or of the sandwich type; the latter may be in layers or sheets of the same material or of different materials such as: steel, aluminum, plaster, wood, agglomerates, plastic or others.

In this arrangement, ceiling panels will present a novel feature since they are interchangeable with other panels with different features or even with other components such as: doors (FIG. 3), windows (FIG. 4), partial or complete frames (FIG. 5), glass plates (FIG. 6) or others, since all of these are provided with the same size and the same securing system. This feature provides a great number of variations, which render the construction arrangement extremely pliable. It should be further emphasized that this component rehandling may be carried out at any time, without limiting the user to a rigid and permanent scheme.

Roof, ceiling and trough 3 may be of wrought steel, aluminum, plastic and other materials, separately or in combination. The roof is independent for each cell, it being connected with troughs for carrying off rain water.

Floor 4 — The floor may be of wood, agglomerates, plastic, steel, aluminum, concrete and other convenient materials, also independent for each cell.

Foundation brackets 5 — One of the most convenient means of securing the cell onto the ground will be the prefabricated brackets in concrete, metal, plastic or other materials, since they present advantages for cell assembly. Foundations, however, may be of various types, according to the features of the land on which the building is to be assembled.

Cell components may be assembled with one another (FIG. 7), all elements being joined through fittings, weldings, screws, pins, bolts, adhesives, wedges, clamps, nails and other fastening procedures.

Figure 8:
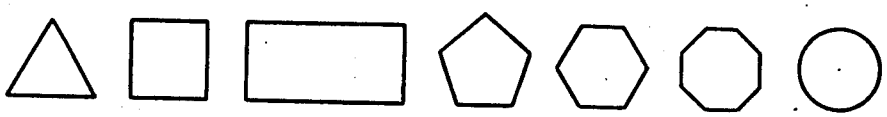
FIG. 8 illustrates various configurations which may be taken by the modular housing unit of the invention.

Cells may present various forms (FIG. 8) such as the projections shown in the triangular, quadrangular, rectangular, pentagonal, hexagonal, octogonal, circular and other shapes.

Figure 9:
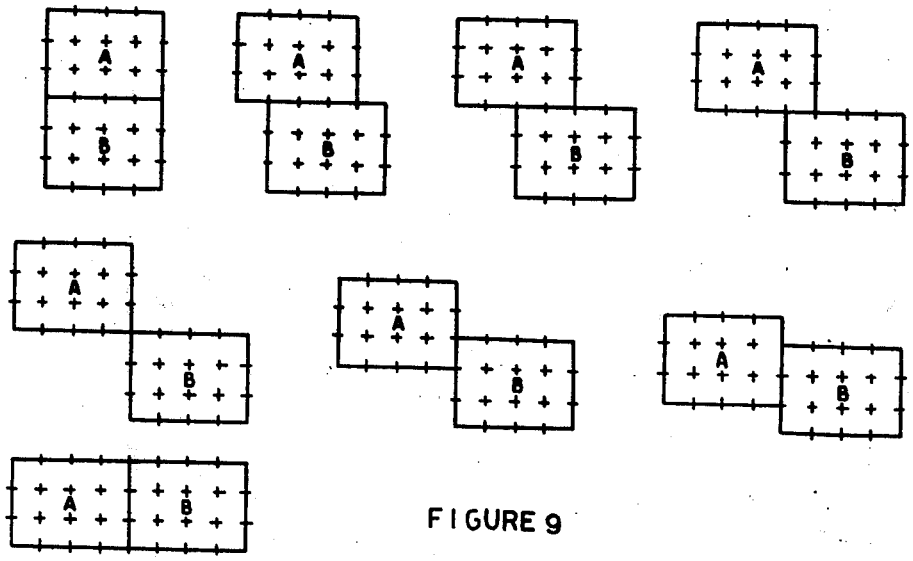
FIG. 9 illustrates various possible groupings of modular units of the invention.

Cells offer a grouping versatility (FIG. 9).

Groupings of two or more cells provide all layout alternatives as to rooms or appurtenances, so as to efficiently meet the requirements and necessities of the construction.

In the housing field each cell may constitute a portion of the building; however, it may be divided into two or more parts or, further, two or more cells may form one sole ample room and in desired shape.

Cell groupings possibilities are numberless and such groupings may be both in the horizontal and in the vertical plane.

Groupings may be provided with two or more cells of the same form or of different shapes.

In order to illustrate one grouping of equal forms or shapes, FIG. 9 shows various positions thereof.

From these various grouping forms (FIG. 9) one notes the advantages of independent roofs for each cell, permitting the coupling of one or more cells, at any time, without the necessity of modifiying the existing roof.

As in the case of the independent roof for each cell, structures, panels, floors and brackets also provide the same advantage without the necessity of modifying already existing means.

Figure 10:
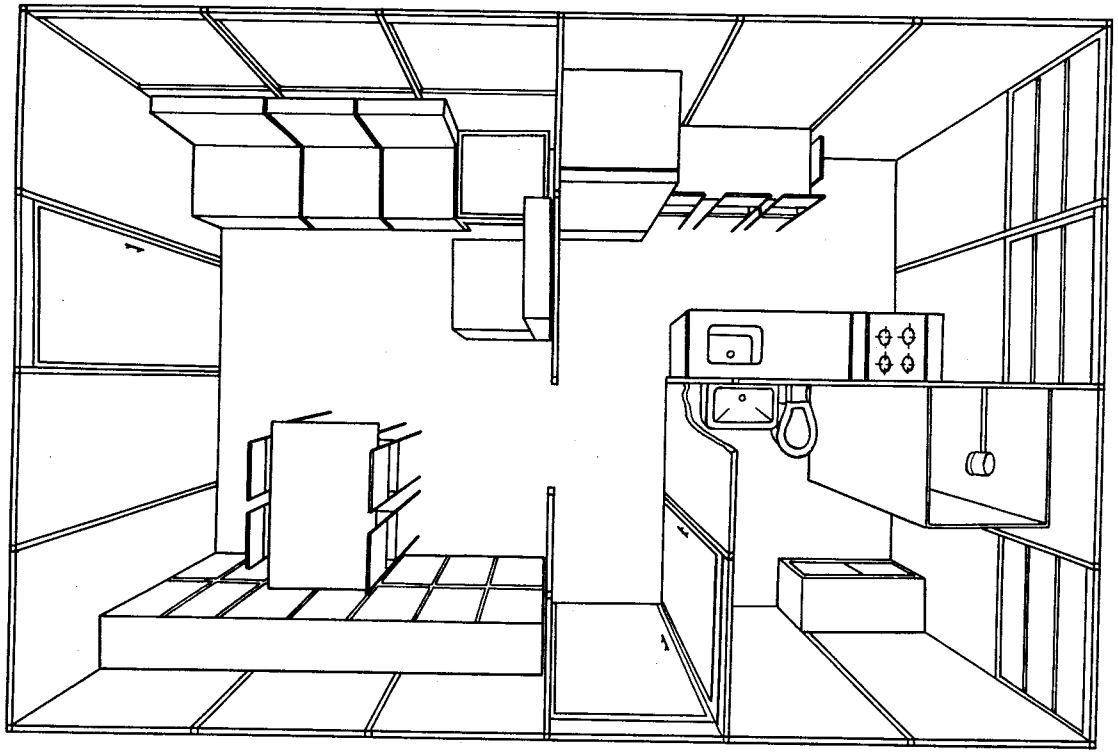
FIG. 10 is a perspective view from above showing a pair of modular units of the invention without the roof and ceiling structures so as to illustrate the interiors thereof.

The minimum initial dwelling provided is formed by the grouping of two modular stanch cells, one of which will necessarily be the sanitary and service cell, composed of bath-room, kitchen and circulation corridor (lattice) and another simple cell for drawing-room and/or sleeping-room (FIG. 10).

This dwelling may be then increased according to the user's requirements and conditions, through the purchase of another cell of any type or shape, as previously explained.

Therefore, one may obtain a form similar to that of FIG. 11, where the grouping was made in the horizontal and vertical planes, elevated from the ground.

As it may be noted from the foregoing and from the attached drawings, various features are submitted by the "CELLULAR CONSTRUCTIONS OF A CONTINUOUS STRUCTURE", providing extraordinary technical and economical advantages which will meet all indispensable features required, so as to render them deserving of the privilege of an invention patent as now requested.

As is apparent from FIG. 11, each of the modular units 10 has a peripheral floor means 12 and a peripheral roof means 14 which can be joined with the floor means 12 of a modular unit 10 which is placed on top of another modular unit. The roof means 14 is in the form of a ledge which surrounds the roof 16 which is pitched in all directions downwardly with the roof means 14 having an upper edge situated at least as high as the highest part of the pitched roof 16 so that it becomes possible to arrange the units one on top of the other even though each unit has a downwardly pitched roof.

Claims are briefly made for: "Cellular Constructions of a Continuous Structure" with the following characteristic points:

We claim:

1. In a housing construction to be inhabited by human beings, a plurality of modular housing units to be assembled together to provide a housing construction of a desired size and configuration having a desired number of rooms, each of said modular units having a peripheral floor means and a peripheral roof means for connecting a pair of said modular units to each other with one of the modular units situated over the other of the modular units, each of said modular units including a floor means surrounded by a peripheral floor means and a roof means surrounded by said peripheral roof means, and said peripheral roof means extending to an elevation at least as high as the highest elevation of said roof means surrounded thereby, said roof means which is surrounded by said peripheral roof means being at least in part pitched downwardly toward said peripheral roof means.

2. The combination of claim 1 and wherein each of said modular units includes between said peripheral floor and roof means a plurality of walls each composed of a number of panels of identical size and shape each having a height equal to the distance between said peripheral floor and roof means of each unit with some of said panels carrying window structures and some of said panels carrying door structures.

3. The combination of claim 2 and wherein each of said modular units includes ceiling panels of the same size and shape as said panels of said walls.

4. The combination of claim 1 and wherein said roof means which is surrounded by said peripheral roof means is on all sides pitched downwardly toward said peripheral roof means.

5. The combination of claim 1 and wherein said modular units are in a horizontal plane of a polygonal configuration for providing a construction according to which said modular units can be assembled together in side by side relation as well as one above the other to provide both horizontal and vertical combinations of said modular units.

6. The combination of claim 5 and wherein at least one of said modular units contains plumbing facilities.

* * * * *